US010449762B2

(12) United States Patent
Przybyla et al.

(10) Patent No.: US 10,449,762 B2
(45) Date of Patent: Oct. 22, 2019

(54) FLUID EJECTION DEVICE

(71) Applicant: HEWLETT-PACKARD DEVELOPMENT COMPANY, L.P., Houston, TX (US)

(72) Inventors: James R. Przybyla, Corvallis, OR (US); Zhizhang Chen, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/748,301

(22) PCT Filed: Oct. 30, 2015

(86) PCT No.: PCT/US2015/058428
§ 371 (c)(1),
(2) Date: Jan. 29, 2018

(87) PCT Pub. No.: WO2017/074446
PCT Pub. Date: May 4, 2017

(65) Prior Publication Data

US 2018/0222203 A1 Aug. 9, 2018

(51) Int. Cl.
*B41J 2/14* (2006.01)
*B41J 2/16* (2006.01)

(52) U.S. Cl.
CPC ..... *B41J 2/14129* (2013.01); *B41J 2/1408* (2013.01); *B41J 2/14016* (2013.01);
(Continued)

(58) Field of Classification Search
CPC .. B41J 2/14129; B41J 2/14088; B41J 2/1408; B41J 2/14112; B41J 2/14016
See application file for complete search history.

(56) References Cited

U.S. PATENT DOCUMENTS 5,733,433 A * 3/1998 Lee ..... B41J 2/14129 205/665
5,877,791 A 3/1999 Lee et al.
(Continued)

FOREIGN PATENT DOCUMENTS

CN 1769050 5/2006
CN 101058086 10/2007
(Continued)

OTHER PUBLICATIONS

Maydannik, Spatial ALD at low temperature for flexible electronics encapsulation using a BENEQ R2R, BALD Engineering, Mar. 10, 2015, 5 pgs.

*Primary Examiner* — Geoffrey S Mruk
(74) *Attorney, Agent, or Firm* — HP Inc. Patent Department

(57) ABSTRACT

According to an example, a fluid ejection device may include a substrate, a resistor positioned on the substrate, an overcoat layer positioned over the resistor, a fluidics layer having surfaces that form a firing chamber about the resistor, in which the overcoat layer is positioned between the resistor and the firing chamber, and a thin film membrane covering the surfaces of the fluidics layer that form the firing chamber and a portion of the overcoat layer that is in the firing chamber.

19 Claims, 6 Drawing Sheets

(52) U.S. Cl.
CPC ..... *B41J 2/14088* (2013.01); *B41J 2/14112* (2013.01); *B41J 2/1603* (2013.01); *B41J 2/1646* (2013.01); *B41J 2/1629* (2013.01); *B41J 2/1631* (2013.01); *B41J 2/1634* (2013.01); *B41J 2/1642* (2013.01)

(56) References Cited

U.S. PATENT DOCUMENTS

| | | | | |
|---|---|---|---|---|
| 6,354,695 | B1 | 3/2002 | Kim et al. | |
| 6,739,519 | B2 | 5/2004 | Stout et al. | |
| 6,857,727 | B1 | 2/2005 | Rausch et al. | |
| 7,025,894 | B2 | 4/2006 | Hess et al. | |
| 7,332,100 | B2 * | 2/2008 | Giovanola ..... | B41J 2/1404 216/27 |
| 8,573,740 | B2 | 11/2013 | Rivas et al. | |
| 8,727,499 | B2 | 5/2014 | Pugliese et al. | |
| 8,905,522 | B2 | 12/2014 | Koyata et al. | |
| 2003/0189622 | A1 | 10/2003 | Giere et al. | |
| 2005/0243141 | A1 | 11/2005 | Shaarawi et al. | |
| 2008/0198202 | A1 | 8/2008 | Shaarawi et al. | |
| 2013/0083131 | A1 | 4/2013 | Chung et al. | |

FOREIGN PATENT DOCUMENTS

| | | |
|---|---|---|
| CN | 102152632 | 8/2011 |
| CN | 103003073 | 3/2013 |
| KR | 1019960021538 | 7/1996 |
| KR | 20000001904 | 1/2000 |
| WO | WO/2015/116051 | 8/2015 |

* cited by examiner

FLUID EJECTION DEVICE

BACKGROUND

Thermal inkjet printheads eject fluid ink drops from nozzles by passing electrical current through resistor elements contained in a firing chamber. Heat from a resistor element creates a rapidly expanding vapor bubble that forces a small ink drop out of a nozzle of the firing chamber. When the resistor element cools, the vapor bubble quickly collapses and draws more fluid ink into the firing chamber in preparation for ejecting another drop through the nozzle. Fluid ink is drawn from a reservoir via a fluid slot that extends through the substrate on which the resistor element and the firing chamber are formed.

BRIEF DESCRIPTION OF THE DRAWINGS

Features of the present disclosure are illustrated by way of example and not limited in the following figure(s), in which like numerals indicate like elements, in which.

DETAILED DESCRIPTION

For simplicity and illustrative purposes, the present disclosure is described by referring mainly to an example thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

Additionally, It should be understood that the elements depicted in the accompanying figures may include additional components and that some of the components described in those figures may be removed and/or modified without departing from scopes of the elements disclosed herein. It should also be understood that the elements depicted in the figures may not be drawn to scale and thus, the elements may have different sizes and/or configurations other than as shown in the figures.

Disclosed herein are fluid ejection devices and methods of fabricating the fluid ejection devices. The fluid ejection devices may include a fluidics layer that includes surfaces that form a firing chamber about, e.g., around, a resistor. According to an example of the present disclosure, a thin film membrane may be formed to cover the surfaces of the fluidics layer that form the firing chamber. The thin film membrane may thus form a barrier between the fluidics layer and the firing chamber. In this regard, the thin film membrane may protect the fluidics layer from delamination and decomposition that may be caused by the fluid contained in the firing chamber, particularly when the fluid contains aggressive ink chemistries.

According to an example, by protecting the fluidics layer in the fluid ejection devices, the fluid ejection devices may be made with relatively larger firing chambers, may have greater durability, and may be able to print with improved optical density as compared with conventional fluid ejection devices. The thin film membrane may also form a wettable coating over the walls of the firing chamber, which may facilitate filling of the firing chamber with fluid. As disclosed herein, the thin film membrane may be applied at any of a number of stages during the manufacture of a fluid ejection device following formation of the fluidic layer. In addition, the thin film membrane may be formed through a deposition technique that may be performed at relatively low temperatures, such as atomic layer deposition.

Figure 1:
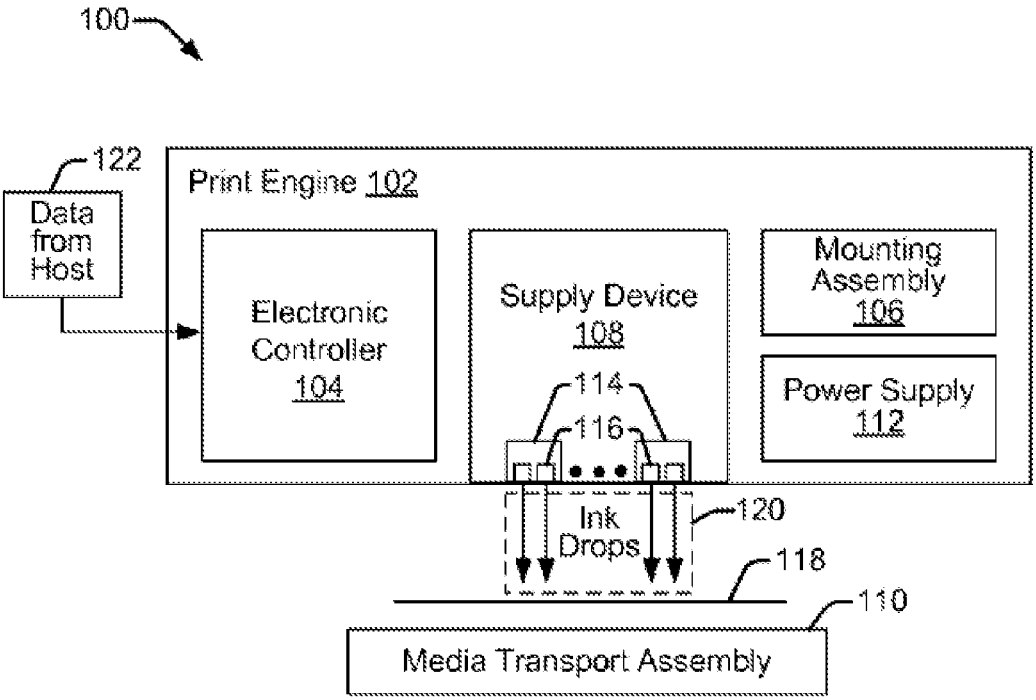
FIG. 1 shows a simplified block diagram of a fluid ejection system having a thin film membrane covering the walls of a firing chamber, according to an example of the present disclosure.
Figure 2:
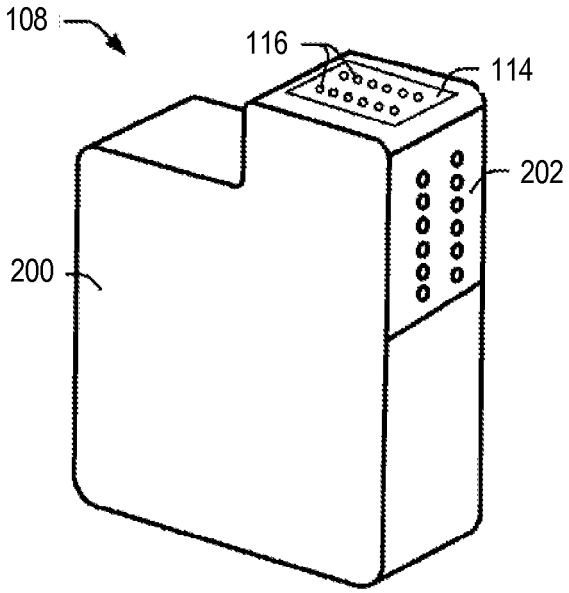
FIG. 2 shows a fluid supply device implemented as an ink cartridge, according to an example of the present disclosure.

With reference first to FIG. 1, there is shown a simplified block diagram of a fluid ejection system 100 having a thin film membrane covering the walls (or surfaces) of a firing chamber, according to an example of the present disclosure. The fluid ejection system 100 may be an inkjet printing system 100 that includes a print engine 102 having an electronic controller 104, a mounting assembly 106, a replaceable fluid supply device 108 or fluid supply devices (e.g., as shown in FIG. 2), a media transport assembly 110, and a power supply 112 that provides power to the various electrical components of inkjet printing system 100. The inkjet printing system 100 further includes fluid ejection devices 114 implemented as printheads 114 that eject drops of ink or other fluid through a plurality of nozzles 116 (also referred to as orifices or bores herein) toward print media 118 so as to print onto the print media 118.

In some examples, a printhead 114 may be an integral part of a supply device 108, while in other examples, a printhead 114 may be mounted on a print bar (not shown) of the mounting assembly 106 and coupled to a supply device 108 (e.g., via a tube). The print media 118 may be any type of suitable sheet or roll material, such as paper, card stock, transparencies, Mylar, polyester, plywood, foam board, fabric, canvas, and the like.

The printhead 114 in FIG. 1 is depicted as a thermal-inkjet (TIJ) printhead 114. In TIJ printheads 114, electric current is passed through a resistor element to generate heat in an ink-filled chamber. The heat vaporizes a small quantity of ink or other fluid, creating a rapidly expanding vapor bubble that forces a fluid drop out of a nozzle 116. As the resistor element cools the vapor bubble collapses, drawing more fluid from a reservoir into the chamber in preparation for ejecting another drop through the nozzle 116. The nozzles 116 are typically arranged in one or more columns or arrays along printhead 114 such that properly sequenced ejection of ink from the nozzles 116 causes characters, symbols, and/or other graphics or images to be printed on the print media 118 as the printhead 114 and the print media 118 are moved relative to each other.

The mounting assembly 106 positions the printhead 114 relative to the media transport assembly 110, and the media transport assembly 110 positions the print media 118 relative to the printhead 114. Thus, a print zone 120 may be defined adjacent to the nozzles 116 in an area between the printhead 114 and the print media 118. In one example, the print engine 102 is a scanning type print engine. In this example, the mounting assembly 106 includes a carriage for moving the printhead 114 relative to the media transport assembly 110 to scan the print media 118. In another example, the print engine 102 is a non-scanning type print engine. In this example, the mounting assembly 106 fixes the printhead 114 at a prescribed position relative to the media transport assembly 110 while the media transport assembly 110 positions the print media 118 relative to the printhead 114.

The electronic controller 104 may include components such as a processor, memory, firmware, and other printer electronics for communicating with and controlling the supply device 108, the printhead 114, the mounting assembly 106, and the media transport assembly 110. The electronic controller 104 may receive data 122 from a host system, such as a computer, and may temporarily store the data 122 in a memory. The data 122 may represent, for example, a document and/or file to be printed. Thus, the data 122 may form a print job for the inkjet printing system 100 that includes print job commands and/or command parameters. Using the data 122, the electronic controller 104 may control the printhead 114 to eject ink drops from the nozzles 116 in a defined pattern that forms characters, symbols, and/or other graphics or images on the print medium 118.

Turning now to FIG. 2, there is shown a fluid supply device 108 implemented as an ink cartridge 108, according to an example of the present disclosure. The ink cartridge supply device 108 generally includes a cartridge body 200, a printhead 114, and electrical contacts 202. Individual fluid drop generators within the printhead 114 may be energized by electrical signals provided at the contacts 202 to eject fluid drops from selected nozzles 116. The fluid may be any suitable fluid used in a printing process, such as various printable fluids, inks, pre-treatment compositions, fixers, and the like. In some examples, the fluid may be a fluid other than a printing fluid. The supply device 108 may contain its own fluid supply within cartridge body 200, or the supply device 108 may receive fluid from an external supply (not shown) such as a fluid reservoir connected to the device 108 through a tube, for example.

Figure 3:
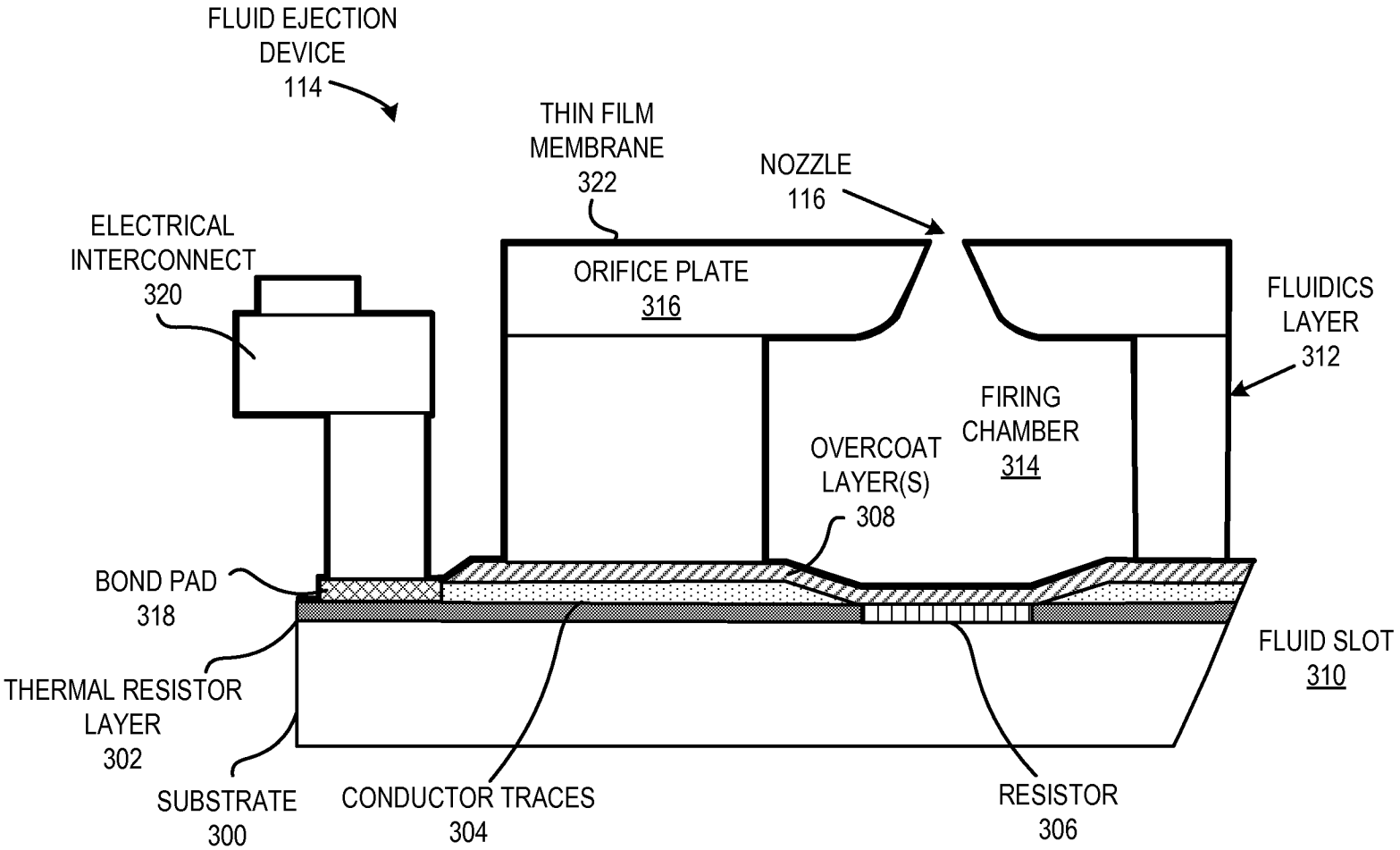
FIG. 3 shows a partial cross-sectional view of a fluid ejection device (or printhead) that employs a thin film membrane over the components of the fluid ejection device to protect, for instance, a fluidics layer from damage caused by ink in a firing chamber, according to an example of the present disclosure.

With reference now to FIG. 3, there is shown a partial cross-sectional view of a fluid ejection device (or printhead) 114 that employs a thin film membrane 322 over the components of the fluid ejection device 114 to protect, for instance, a fluidics layer from damage caused by ink in a firing chamber, according to an example of the present disclosure. The fluid ejection device 114 is depicted as including a substrate 300, which may be made of silicon (Si), or another appropriate material such as glass, a semiconductive material, various composites, and so on. A stack of thin film materials on the substrate 300 and the formation of a fluid slot through the substrate 300 and the thin film stack may provide functionality to the fluid ejection device 114.

The thin film stack may include a sealant or capping layer (not shown) over the substrate 300 such as a thermally grown field oxide and an insulating glass layer deposited, for example, by plasma enhanced chemical vapor deposition (PECVD) techniques. The capping layer forms an oxide underlayer for the thermal resistor layer 302. Although not shown, a Field Effect transistor (FET) may be created in the substrate 300 and may be connected to the resistor 306 via conductive traces 304, in which the FET is to turn the resistor 306 on and off according to data from the electronic controller 104. Thermal/firing resistors may be formed by depositing (e.g., by sputter deposition) the thermal resistor layer 302 over the substrate 300. The thermal resistor layer 302 may be on the order of about 0.1 to 0.75 microns thick, and may be formed of various suitable resistive materials including, for example, tantalum aluminum, tungsten silicon nitride, nickel chromium, carbide, platinum, titanium nitride, etc. Resistor layers having other thicknesses are also within the scope of this disclosure.

A conductive layer formed of the conductor traces 304 may be deposited (e.g., by sputter deposition techniques) on the thermal resistive layer 302 and may be patterned (e.g., by photolithography) and etched to form the conductor traces 304 and an individually formed resistor 306 from the underlying resistive layer 302. The conductive traces 304 may be made of various materials including, for example, aluminum, aluminum/copper alloy, copper, gold, and so on. An overcoat layer 308 (or overcoat layers) may be formed over the resistor 306 to provide additional structural stability and electrical insulation from fluid in the firing chamber 314. The overcoat layer(s) 308 may generally be considered to be part and parcel of the resistor 306, and, as such, may provide a final layer to the resistor 306. The overcoat layer(s) 308 may include an insulating passivation layer formed over the resistor 306 and the conductor traces 304 to prevent electrical charging of the fluid or corrosion of the device in the event that an electrically conductive fluid is used.

The passivation layer may have a thickness on the order of about 0.1 to 0.75 microns, but may have other thicknesses, and may be formed (e.g., by sputtering, evaporation, PECVD, etc.) of suitable materials such as silicon dioxide, aluminum oxide, silicon carbide, silicon nitride, glass, etc. The overcoat layer(s) 308 may also include a cavitation barrier layer over the passivation layer that helps dissipate the force of the collapsing drive bubble left in the wake of each ejected fluid drop. The cavitation layer may have a thickness on the order of about 0.1 to 0.75 microns but may also have a greater or lesser thickness, and may be formed of tantalum deposited by a sputter deposition technique.

The cavitation layer may generally be considered to be the final layer of the resistor 306 and may therefore make up the surface of the resistor 306. Fluid may flow from a fluid source through a fluid slot 310 in the substrate 300 and the fluid may flow into the firing chamber 314 through another slot (not shown). The fluid slot 310 may be formed in the substrate 300 by processes that include, for example, a laser ablation step followed by a non-isotropic wet etch step using chemicals such as potassium hydroxide (KOH) or tetramethylammonium hydroxide (TMAH). The laser ablation step may micromachine a deep trench in the substrate 300, starting at the bottom of the substrate and proceeding up through the substrate to remove a bulk portion of the substrate. The wet etch step may generally complete formation of the laser deep trench by both removing the substrate 300 from the frontside where the thin film layers 302, 304 and 308 have been previously removed and removing the substrate 300 proceeding from the backside of the deep laser trench. In addition, or alternatively, the fluid slot 310 may be formed through a laser ablation step, followed by a dry etch step, and by a wet etch step.

As also shown in FIG. 3, the fluid ejection device 114 may include a fluidics layer 312, which may be a pattered SU8 layer or other polymeric compound such as IJ5000 formed onto the top of the substrate 300 as a dry film laminated by heat and pressure, for example, or as a wet film applied by spin coating. SU8 and IJ5000 are photoimageable negative acting compounds, and the firing chamber 314 (and other channels/passageways) may be formed in the fluidics layer 312 by photo imaging techniques. An orifice plate 316 including nozzles (orifices) 116 may be provided over respective firing chambers 314 such that each firing chamber 316, associated nozzle 116, and associated thermal resistor 306 are aligned. In some examples, the fluidics layer 312 and the orifice plate 316 are integrated as a single structure formed of SU8 or another appropriate material. In other examples, the orifice plate 316 is a separate element and is attached or adhered to the fluidics layer, as shown in FIG. 3.

The fluid ejection device 114 is further depicted as including a bond pad 318, which may be formed of an electrically conductive material, such as gold, in electrical communication with the conductor traces 304. The bond pad 318 is also depicted as being in electrical communication with an electrical interconnect 320. The electrical interconnect 320, which may be a flexible electrical interconnect 320, may electrically connect the resistor 306 to the electrical contacts 202 (FIG. 2). In this regard, the resistor 306 may receive firing signals via the electrical interconnect 320.

Also shown in FIG. 3 is a thin film membrane 322 that covers most of the exposed surfaces of the fluid ejection device 114 shown in that figure. According to an example, the thin film membrane 322 may be a film that is to act as a barrier between the fluid (e.g., ink) contained in the firing chamber 314 and the fluidics layer 312. In one regard, the thin film membrane may protect the fluidics layer 312 from decomposing upon exposure to certain types of fluids, e.g., fluids with aggressive chemistries, and may also protect the fluidics layer 312 from delaminating from the substrate 300. The thin film membrane 322 may also provide additional protection to the resistor 306. Moreover, the thin film membrane 322 may provide moisture protection on the electrical interconnect 320, which may improve reliability of the electrical interconnect 320.

The thin film membrane 322 may be formed of a dielectric material, such as a metal oxide. Examples of suitable materials may include hafnium oxide, titanium oxide, aluminum oxide, hafnium silicon nitride, silicon oxide, silicon nitride, or the like. In addition, the thin film membrane 322 may be formed through atomic layer deposition (ALD) of the thin film materials at a relatively low temperature, e.g., less than about 150° Celsius. By depositing the thin film materials at the relatively low temperature, damage caused by high heat to the fluidics layer 312 and other components of the fluid ejection device 114 may be avoided. ALD of the thin film materials may also be performed to make the thin film membrane 322 have a relatively small thickness, e.g., about 100 angstroms, and the thin film membrane 322 may be formed to be pinhole and crack free and to conformally coat the wall(s) of the fluidics layer 312 forming the firing chamber 314.

Although the thin film membrane 322 has been depicted in FIG. 3 as being formed onto the fluidics layer 312, the orifice plate 316, and the electrical interconnect 320, in other examples, the thin film membrane 322 may be formed prior to the formation or placement of one or more of these components. For instance, the thin film membrane 322 may be formed prior to attachment of the electrical interconnect 320 onto the bond pad 318 and/or prior to the attachment of the orifice plate 316 onto the fluidics layer 312. In an example in which the thin film membrane 322 is formed prior to attachment of the electrical interconnect 320 to the bond pad 318, a portion of the thin film membrane 322 may be formed on top of the bond pad 318. In one example, the electrical interconnect 320 may be positioned directly on top of that portion of the thin film membrane 322 as the thin film membrane 322 may be sufficiently thin to enable sufficient levels of electrical signals to pass therethrough. In another example, the portion of the thin film membrane 322 that is positioned directly on top of bond pad 318 may be removed prior to attachment of the electrical interconnect 320 to the bond pad 318. In this example, the portion of the thin film membrane 322 on top of the bond pad 318 may be removed via etching or other suitable manner of removal. Various other examples regarding the formation of the thin film membrane 322 are described in detail herein below.

Figure 4:
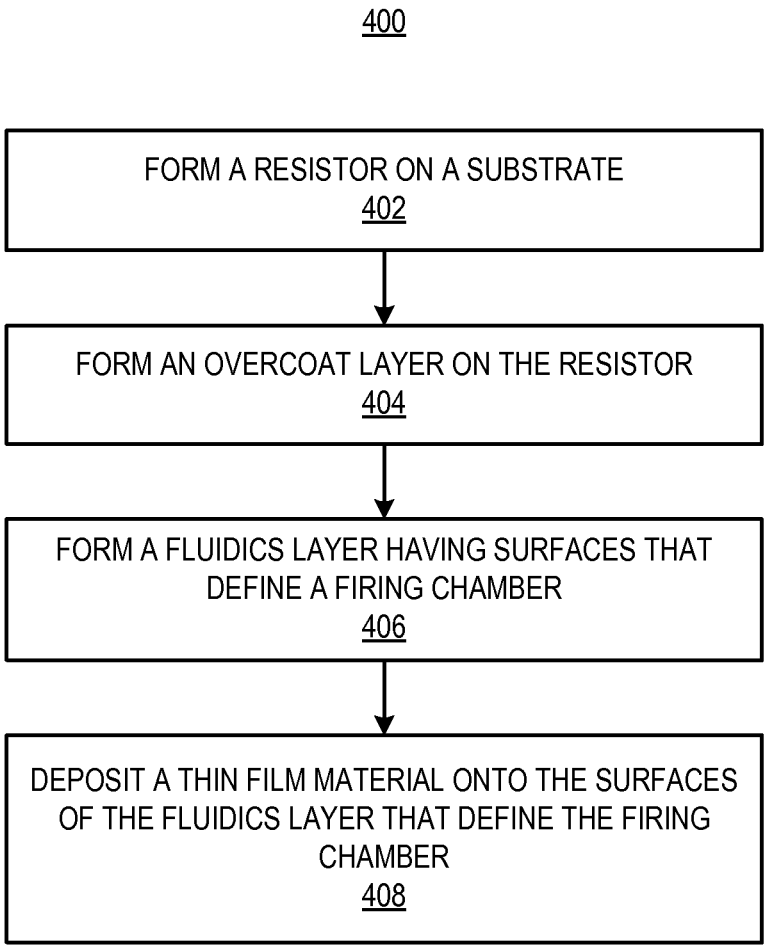
FIG. 4 shows a flow diagram of a method of fabricating a fluid ejection device, such as the fluid ejection device depicted in FIGS. 1-3, according to an example of the present disclosure.

With reference now to FIG. 4, there is shown a flow diagram of a method 400 of fabricating a fluid ejection device, such as the fluid ejection device 114 depicted in FIGS. 1-3, according to an example of the present disclosure. Although the method 400 includes blocks listed in a particular order, it is to be understood that this does not necessarily limit the blocks to being performed in this or any other particular order. In general, in addition to the fabrication techniques specifically called out in the method 400, the various operations in the method 400 may be performed using various precision microfabrication techniques such as electroforming, laser ablation, anisotropic etching, sputtering, dry etch, wet etch, photolithography, etc.

Various operations in the method 500 are also described with respect to FIGS. 5A-5F, which show various stages of fabrication of the fluid ejection device 114.

Figure 5A:
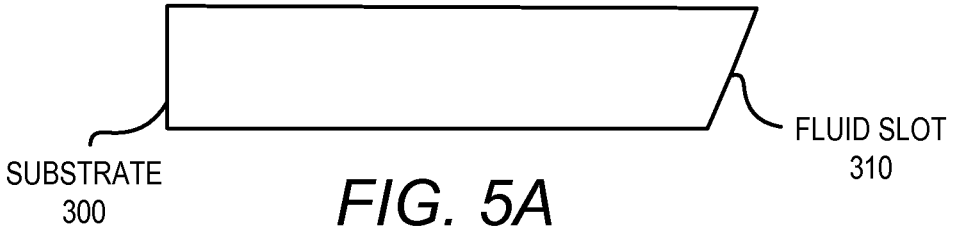
FIGS. 5A-5F show various stages of fabrication of the fluid ejection device depicted in FIGS. 1-3, according to an example of the present disclosure.
Figure 5B:
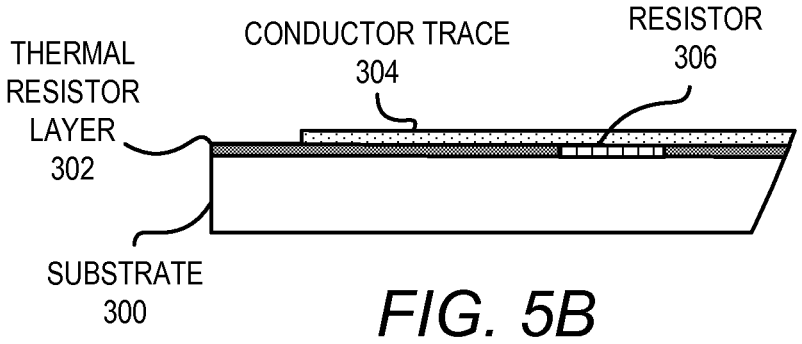

As shown in FIG. 4, at block 402, a resistor 306 may be formed on a substrate 300. According to an example, the substrate 300, which may be formed of silicon or other material such as, glass, a semiconductive material, a composite material, etc., may be obtained as shown in FIG. 5A. The substrate 300 may be formed with a fluid slot prior to or after formation of the resistor 306 on the substrate 300. In addition, the resistor 306 may be formed on the substrate 300, for instance, by sputter deposition, and may be formed of various materials and thicknesses as noted above. The formation of the resistor 306 may also include the formation of the thermal resistor layer 302 and the conductor traces 304, as also discussed above and as shown in FIG. 5B.

Figure 5C:
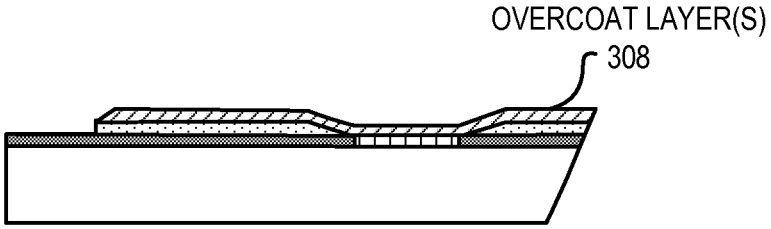

At block 404, an overcoat layer 308 or overcoat layers 308 may be formed on the resistor 306. For instance, the overcoat layer(s) 308 may be deposited onto the conductor trace 304 and the resistor 306 through any suitable deposition process. An example of the deposited overcoat layer(s) 308 is shown in FIG. 5C. As shown therein, a portion of the conductor trace 304 may be removed prior to deposition of the overcoat layer(s) 308. In addition, the deposition of the overcoat layer(s) 308 may form a final layer of the resistor 306 and may be referred to as a cavitation barrier layer. The overcoat layer(s) 308 made of tantalum, for example.

Figure 5D:
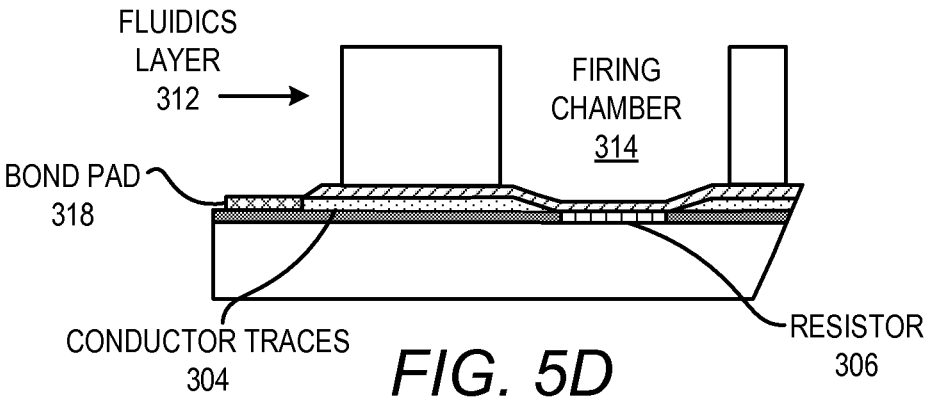

At block 406, a fluidics layer 312 may be formed over the substrate 300. As discussed above, the fluidics layer 312 may be a film, such as SU8 or IJ5000, that is applied over the substrate 300 and patterned using photo imaging techniques. In one regard, the fluidics layer 312 may be patterned to have surfaces that define a firing chamber 314 about the resistor 306, among other features. An example of the fluidics layer 312 and the firing chamber 314 are shown in FIG. 5D. As also shown in FIG. 5D, a bond pad 318 may be formed to be in electrical contact with the conductor traces 304 such that electrical signals may be communicated to the resistor 306 through the bond pad 318 and the conductor traces 304.

Figure 5E:
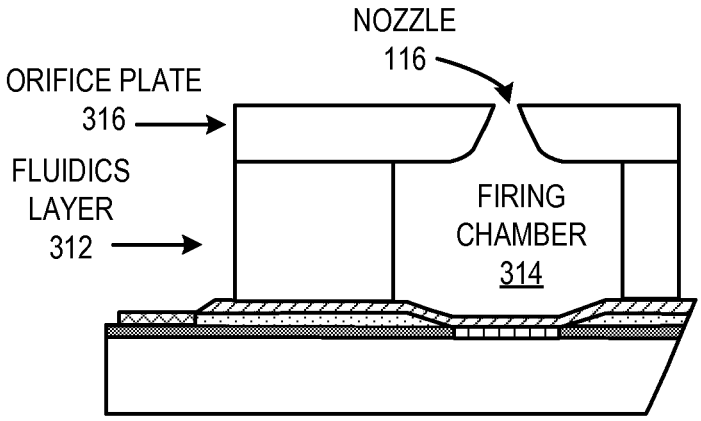
Figure 5F:
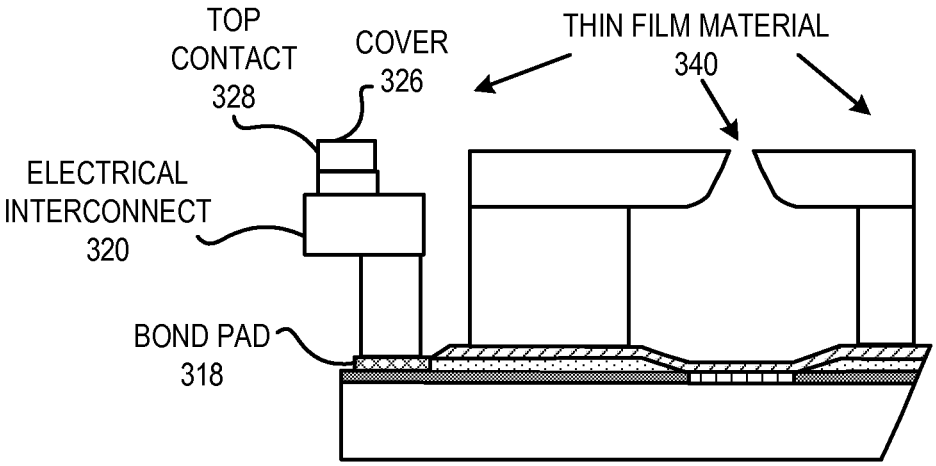

In addition, as shown in FIG. 5E, an orifice plate 316 may be positioned on the fluidics layer 312 such that a nozzle 116 of the orifice plate 316 is positioned over and in fluid communication with the firing chamber 314. Moreover, as shown in FIG. 5F, an electrical interconnect 320 may be placed in electrical communication with the bond pad 318. The electrical interconnect 320 may include contacts formed of electrically conductive materials, e.g., gold, one of which may be bonded to the bond pad 318 through any suitable bonding technique. According to an example, the electrical interconnect 320 is a flexible electrical interconnect 320.

At block 408, a thin film material may be deposited onto the surfaces of the fluidics layer 312 that define the firing chamber 314 and a portion of the overcoat layer(s) 308 that forms part of the firing chamber 314 to form a thin film membrane 322 that covers the surfaces of the fluidics layer that define the firing chamber and the portion of the overcoat layer that forms part of the firing chamber. The thin film material may be a material selected from the group of materials including hafnium oxide, titanium oxide, aluminum oxide, hafnium silicon nitride, silicon oxide, or the like. According to an example, and as shown in FIG. 5F, the thin film material 324 may be deposited through atomic layer deposition (ALD). Through performance of ALD, the thin film material 324 may be deposited over the nozzle 116 and may enter into the firing chamber 314, covering the surfaces that form the firing chamber 314.

In addition, ALD of the thin film material 324 may be performed at a relatively low temperature, e.g., less than about 150° Celsius, to thus prevent degradation of the fluidics layer 312 during the deposition process. Moreover, the thin film membrane 322 may be formed to have a substantially constant thickness of about 100 angstroms across the components of the fluid ejection device 114 and to be substantially pinhole and crack free. Following implementation of the method 400, the fluid ejection device 114 may have a thin film membrane 322 as shown, for instance, in FIG. 3. As an alternative to ALD, the thin film material 324 may be deposited through plasma enhanced chemical vapor deposition (PECVD) at low temperature.

According to an example, a cover 326, for instance, tape, may be provided on a top contact 328 of the electrical interconnect 320 prior to deposition of the thin film material 324. In this example, the cover 326 may be removed following formation of the thin film membrane 322 to thus expose the top contact 328 of the electrical interconnect 320.

Figure 6A:
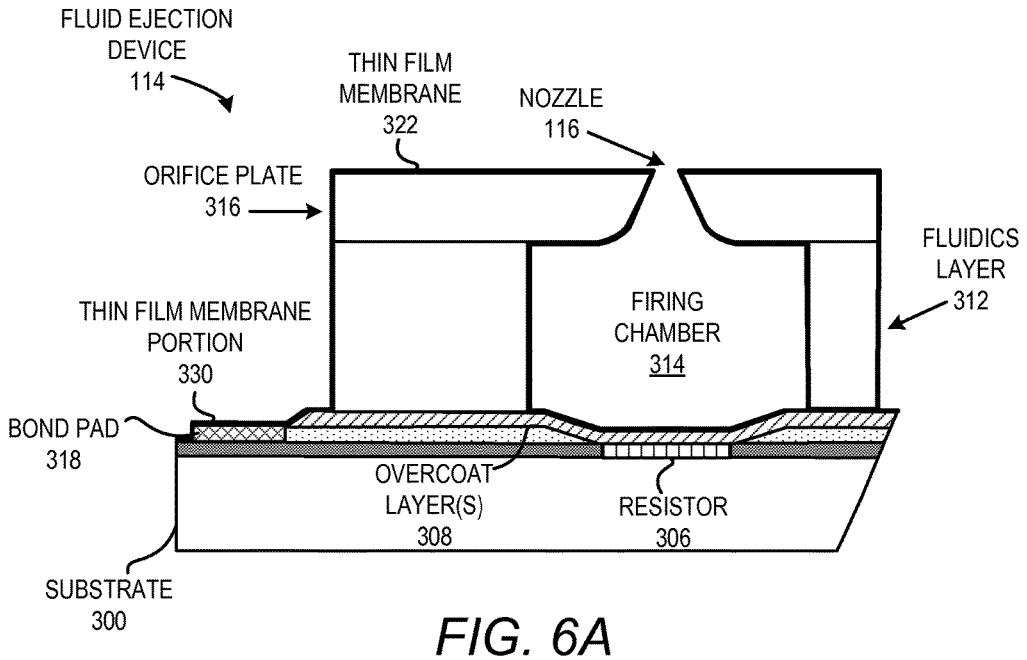
FIGS. 6A and 6B, respectively show partial cross-sectional views of fluid ejection devices that employ a thin film membrane over the components of the fluid ejection device to protect, for instance, a fluidics layer from damage caused by ink in a firing chamber, according to two examples of the present disclosure.

In other examples, however, the thin film membrane 322 may be formed at another other stage of fluid ejection device 114 fabrication. In a first example, the thin film membrane 322 may be formed following placement of the orifice plate 316 on the fluidics layer 312 and prior to placement of the electrical interconnect 320. In this first example, the thin film material 324 may be deposited onto the components as shown in FIG. 6A, which may result in a portion 330 of the thin film membrane 322 covering the bond pad 318. According to an example, the portion 330 of the thin film material 324 covering the bond pad 318 may be removed, for instance, through etching, abrasive techniques, etc., prior to placement of the electrical interconnect 320. In another example, a cover (not shown) may be provided on the bond pad 318 prior to deposition of the thin film material 324 and the cover may be removed following formation of the thin film material 322 and prior to placement of the electrical interconnect 320. In a yet further example, the electrical interconnect 320 may be placed on the portion 330 of the thin film membrane 322 covering the bond pad 318. As the thin film membrane 322 is relatively thin, e.g., around 100 angstroms, electrical signals may flow from the electrical interconnect 320 to the bond pad 318 through the portion 330 of the thin film material 324.

Figure 6B:
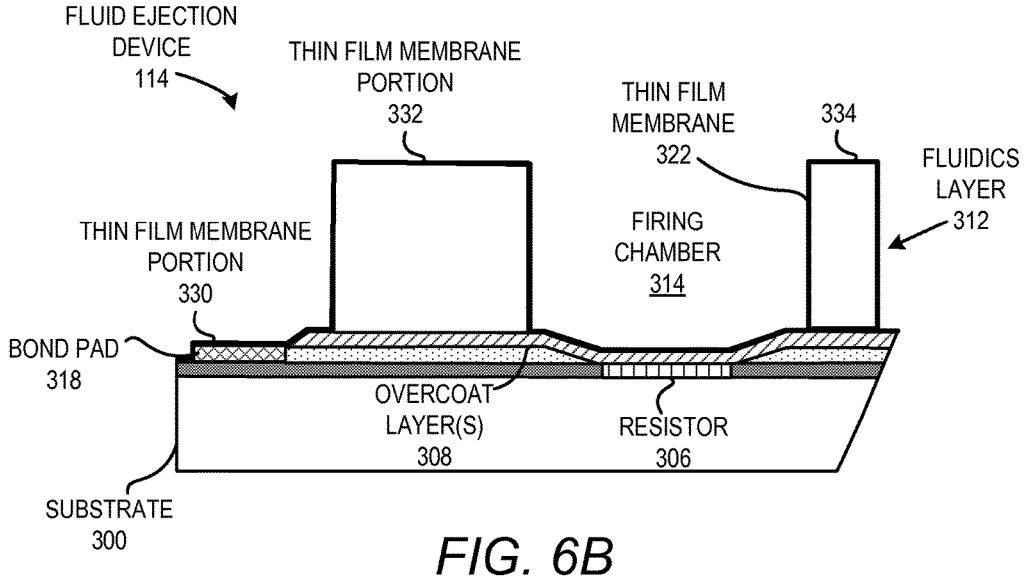

In a second example, the thin film membrane 322 may be formed following formation of the fluidics layer 312 and the firing chamber 314. In this second example, the thin film material 324 may be deposited onto the components as shown in FIG. 6B, which may result in a portion 330 of the thin film material 324 covering the bond pad 318 and other portions 332, 334 of the thin film material 324 covering top surfaces of the fluidics layer 312. The portion 330 of the thin film material 324 covering the bond pad 318 may be removed or may remain as discussed above with respect to the first example. In addition, the portions 332, 334 of the thin film material 324 covering the top surfaces of the fluidics layer 312 upon which the orifice plate 316 is to be placed may also be removed in any of the manners discussed above with respect to the bond pad 318, e.g., etching, abrasive techniques, use of a cover, etc., prior to placement of the orifice plate 316 on the fluidics layer 312. Alternatively, the orifice plate 316 may be placed on top of the fluidics layer 312 with the portions 332, 334 of the thin film membrane 322 positioned therebetween.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A fluid ejection device, comprising:
a substrate;
a resistor positioned on the substrate;
an overcoat layer positioned over the resistor;
a fluidics layer having surfaces that form a firing chamber about the resistor, wherein the overcoat layer is positioned between the resistor and the firing chamber; and
a thin film membrane comprising a dielectric material and covering the surfaces of the fluidics layer that form the firing chamber and covering a portion of the overcoat layer that is in the firing chamber.

2. The fluid ejection device of claim 1, further comprising:
an orifice plate positioned on the fluidics layer, the orifice plate having a nozzle positioned to be in fluid communication with the firing chamber; and
wherein the thin film membrane covers the orifice plate and a wall of the orifice plate that forms the nozzle.

3. The fluid ejection device of claim 1, further comprising:
a bond pad positioned on the substrate outside of the firing chamber, wherein the thin film membrane covers the bond pad.

4. The fluid ejection device of claim 1, further comprising:
a bond pad positioned on the substrate outside of the firing chamber; and an electrical interconnect having an electrical connection with the bond pad, wherein the thin film membrane covers the electrical interconnect.

5. The fluid ejection device of claim 1, wherein the dielectric material of the thin film membrane comprises a metal oxide that is to provide a barrier between the fluidics layer and fluid contained in the firing chamber.

6. The fluid ejection device of claim 1, wherein the thin film membrane is deposited via atomic layer deposition of a metal oxide material at a temperature that is less than about 150° Celsius.

7. The fluid ejection device of claim 1, wherein a thickness of the thin film membrane is about 100 angstroms.

8. The fluid ejection device of claim 1, wherein the dielectric material of the thin film membrane covering the surfaces of the fluidics layer and covering the portion of the overcoat layer comprises a metal oxide.

9. The fluid ejection device of claim 1, wherein the dielectric material of the thin film membrane covering the surfaces of the fluidics layer and covering the portion of the overcoat layer comprises a silicon oxide.

10. The fluid ejection device of claim 1, wherein the dielectric material of the thin film membrane covering the surfaces of the fluidics layer and covering the portion of the overcoat layer comprises a silicon nitride.

11. The fluid ejection device of claim 1, further comprising:

an electrical interconnect having an electrical connection with the bond pad through the thin film membrane.

12. A method of fabricating a fluid ejection device, said method comprising:

forming a resistor on a substrate;

forming an overcoat layer on the resistor;

forming a fluidics layer having surfaces that define a firing chamber, wherein the overcoat layer forms part of the firing chamber; and depositing a thin film material comprising a dielectric material onto the surfaces of the fluidics layer that define the firing chamber and onto a portion of the overcoat layer that forms part of the firing chamber to form a thin film membrane that covers the surfaces of the fluidics layer that define the firing chamber and the portion of the overcoat layer that forms part of the firing chamber.

13. The method of claim 12, further comprising forming an orifice plate on the fluidics layer, the orifice plate having a nozzle positioned to be in fluid communication with the firing chamber, and wherein depositing the thin film material further comprises depositing the thin film material onto the orifice plate to cause the thin film membrane to cover the orifice plate and a wall of the orifice plate that forms the nozzle.

14. The method of claim 12, wherein depositing the thin film material further comprises depositing the thin film material via atomic layer deposition at a temperature that is less than about 150° Celsius.

15. The method of claim 12, further comprising forming a bond pad that is electrically connected to the resistor and an electrical interconnect that is electrically connected to the bond pad, and wherein depositing the thin film material comprises depositing the thin film material onto the electrical interconnect to cause the thin film membrane to cover the electrical interconnect.

16. The method of claim 12, wherein depositing the thin film material comprises depositing the thin film material to form the thin film membrane to have a substantially uniform thickness throughout the thin film membrane.

17. A method of fabricating a fluid ejection device, the method comprising:

forming a resistor on a substrate;

forming an overcoat layer on the resistor;

forming a bond pad in electrical communication with the resistor;

forming a fluidics layer having surfaces that define a firing chamber, wherein the overcoat layer forms part of the firing chamber, and wherein the bond pad is outside of the firing chamber;

positioning an orifice plate on the fluidics layer, the orifice plate having a nozzle positioned to be in fluid communication with the firing chamber;

connecting an electrical interconnect to the bond pad; and forming a thin film membrane onto the electrical interconnect, onto the orifice plate, onto the surfaces of the fluidics layer that define the firing chamber, onto the overcoat layer, and onto surfaces of the fluidics layer that are outside of the firing chamber.

18. The method of claim 17, wherein forming the thin film membrane comprises depositing a metal oxide via atomic layer deposition at a temperature that is less than about 150° Celsius.

19. The method of claim 17, wherein the electrical interconnect includes a connector, the method further comprising:

covering the connector with a cover, wherein forming the thin film membrane comprises forming the thin film membrane on the cover; and removing the cover following formation of the thin film membrane to expose the connector.

* * * * *